US009995078B2

(12) United States Patent
Ishikawa

(10) Patent No.: US 9,995,078 B2
(45) Date of Patent: Jun. 12, 2018

(54) REBOUND SUPPRESSION SYSTEM FOR SLIDING DOOR

(71) Applicant: FANUC Corporation, Yamanashi (JP)

(72) Inventor: Ryuutarou Ishikawa, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days. days.

(21) Appl. No.: 15/286,691

(22) Filed: Oct. 6, 2016

(65) Prior Publication Data

US 2017/0114582 A1 Apr. 27, 2017

(30) Foreign Application Priority Data

Oct. 26, 2015 (JP) ..... 2015-209965

(51) Int. Cl.
*E05D 13/00* (2006.01)
*E05F 5/08* (2006.01)
*E05F 5/00* (2017.01)

(52) U.S. Cl.
CPC ..... *E05F 5/08* (2013.01); *E05F 5/003* (2013.01); *E05Y 2201/21* (2013.01); *E05Y 2201/218* (2013.01); *E05Y 2201/264* (2013.01); *E05Y 2201/474* (2013.01); *E05Y 2900/608* (2013.01)

(58) Field of Classification Search
CPC ..... E05F 5/08; E05F 5/003; E05Y 2900/608
USPC ..... 49/409, 425
See application file for complete search history.

(56) References Cited

U.S. PATENT DOCUMENTS 2,594,058 A * 4/1952 Myhr ..... E05D 15/0665 16/100
2,627,092 A * 2/1953 Grossman ..... E06B 3/4618 49/425
2,786,240 A * 3/1957 Tobiasz ..... E05D 15/0686 16/100
3,613,313 A * 10/1971 Helmick ..... E05D 15/0669 16/91
4,733,499 A * 3/1988 Guddas ..... E05D 13/04 16/102
5,165,142 A * 11/1992 Pilsbury ..... B66B 13/301 16/90

(Continued)

FOREIGN PATENT DOCUMENTS

EP 2365168 B1 * 7/2014 ..... E05D 13/04
EP 2899350 A1 * 7/2015 ..... E05D 13/04

(Continued)

OTHER PUBLICATIONS

Office Action in JP Application No. 2015-209965, dated Aug. 29, 2017, 6pp.

*Primary Examiner* — Jerry E Redman
(74) *Attorney, Agent, or Firm* — Hauptman Ham, LLP

(57) ABSTRACT

A rebound suppression system for a sliding door is provided with a sliding door, a rail provided on an outer frame of the sliding door, a roller secured to the sliding door and configured to rotate in accordance with opening and closing motions of the sliding door, a fitting portion having a width smaller than the width of the roller and provided on at least a part of the rail, a rebound preventing roller having a width smaller than that of the fitting portion, and a pressing mechanism configured to press the rebound preventing roller against the rail and the fitting portion by an elastic body.

17 Claims, 16 Drawing Sheets

(56) References Cited

U.S. PATENT DOCUMENTS 5,461,829 A * 10/1995 Lehto ..... E05D 15/1021 16/87 R
5,906,026 A * 5/1999 Junttila ..... E05C 17/28 16/65
6,003,201 A * 12/1999 Ryczek ..... E05D 13/04 16/87 R
6,018,913 A * 2/2000 Lin ..... E05D 15/56 49/360
6,052,867 A * 4/2000 Haab ..... E05D 15/063 16/87 R
6,418,588 B1 * 7/2002 Haab ..... E05D 15/063 16/87.2
6,945,364 B1 * 9/2005 Wesson ..... B66B 13/30 16/96 R
7,178,638 B2 * 2/2007 Fujita ..... B66B 13/24 187/313
8,402,606 B1 * 3/2013 Tsai ..... E05F 3/18 16/49
2004/0016080 A1 * 1/2004 De Oliveira ..... E05D 15/063 16/97
2004/0098831 A1 * 5/2004 Elmer ..... E05D 15/063 16/89
2011/0067313 A1 3/2011 Walhorn
2011/0147131 A1 * 6/2011 Wang ..... B66B 13/30 187/333
2016/0369548 A1 * 12/2016 Dodge ..... E05F 5/003

FOREIGN PATENT DOCUMENTS

EP 3045642 A1 * 7/2016 ..... E05F 5/003
FR 3001754 A1 * 8/2014 ..... E05B 65/0835
JP 2002-276240 A 9/2002
JP 2006219885 A 8/2006
JP 2012-246653 A 12/2012
JP 5173222 B2 * 4/2013 ..... E05F 5/003
WO WO 2016083217 A1 * 6/2016 ..... E05F 5/003
WO WO 2017065676 A1 * 4/2017 ..... E05F 5/003

* cited by examiner

REBOUND SUPPRESSION SYSTEM FOR SLIDING DOOR

RELATED APPLICATIONS

The present application claims priority to Japanese Patent Application Number 2015-209965, filed Oct. 26, 2015, the disclosure of which is hereby incorporated by reference herein in its entirety.

BACKGROUND OF THE INVENTION

Field of the Invention

The present invention relates to a rebound suppression system for sliding door, and more particularly, to a rebound suppression system for sliding door capable of being easily incorporated into a machine without interfering with other components.

Description of the Related Art

A protective cover of a machine tool is provided with a sliding door that is opened and closed by a rail and rollers in order to externally access the interior. If the sliding door is swiftly opened or closed by an operator, it may sometimes rebound at an end of a movable part. FIG. 18 is a diagram showing an example of the structure of a conventional sliding door.

In the structure example shown in FIG. 18, a sliding door 1 is provided with a plurality of rollers 2, and a rail 4 is secured to its outer frame. As the rollers 2 rotate along the rail 4, the sliding door 1 moves in the direction indicated by M in FIG. 18.

When the sliding door 1 is housed in a door pocket 5, an operator can access the interior from outside the protective cover. Moreover, if the operator moves the sliding door 1 in the direction indicated by N in FIG. 18 to perform machining, a key 3 attached to the sliding door 1 is inserted into a lock mechanism 7 attached to a door frame 6 and locked by the lock mechanism 7, whereby a closed state of the sliding door 1 is maintained.

If the sliding door 1 is then swiftly moved toward the door frame 6 (in the direction indicated by N in FIG. 18), it may sometimes collide swiftly with the door frame 6 and rebound. If the sliding door 1 thus rebounds, a force generated by the rebound of the sliding door 1 is concentrated on the key 3 and the lock mechanism 7, as shown in FIG. 19. Therefore, the lock mechanism 7 is heavily loaded, so that it may be worn or broken. Thus, there is a demand for the suppression of such a rebound.

Moreover, so-called "rattling of a sliding door" may sometimes be caused such that the sliding door 1 cannot move to the innermost part of the door pocket at its open end when it is moved to its open or closed end or the sliding door 1 is not in contact with a fiddle at its closed end, as shown in FIG. 19. If such rattling of a sliding door is caused, a problem occurs that mist and chips leak out of the protective cover through a gap between the sliding door 1 and the fiddle at the closed end, in particular.

In some cases, furthermore, the machine tool is used in a severe environment where a cutting fluid, mist, chips and the like scatter. Therefore, there is a demand for a reduction in causes of failure based on the simplest possible structure of a system for suppressing rebound of a sliding door, and in addition, on the location of the rebound suppression system isolated from the interior of a machining chamber of the machine tool and the outside of the machine tool. On the other hand, various components such as a sensor, actuator, and conducting member are often mounted in positions isolated from the interior of the machining chamber of the machine tool and the outside of the machine tool, so that interference must be avoided. To attain this, the rebound suppression system for sliding door is expected to be small-sized and design flexibility is required of the installation location.

For example, Japanese Patent Application Laid-Open No. 2006-219885 discloses, as a means for overcoming the rebound of a sliding door, a roller latch mechanism that is configured to press a roller against a tapered surface of a roller guide, thereby preventing the sliding door from rebounding.

In the technique disclosed in Japanese Patent Application Laid-Open No. 2006-219885 described above, however, the rebound of the sliding door is prevented by providing a structure such that the roller that is continually pushed up by a spring is attached to the upper part of the door end and is pressed against the tapered surface of the roller guide in the vicinity of a position in which the sliding door is closed.

In many of machine tools, however, a safety switch and other sensors, actuator and the like are attached to the upper part of the door end of the sliding door, and interference with those components sometimes cannot be avoided due to design limitation. Even when the roller is located in a position other than the door end of the sliding door, the roller guide must be disposed based on the movable range of the sliding door, so that the problem of the interference with the other components can be completely avoided.

SUMMARY OF THE INVENTION

Accordingly, an object of the present invention is to provide a rebound suppression system for sliding door capable of being easily incorporated into a machine without interfering with other components.

A first aspect of a rebound suppression system for sliding door according to the present invention comprises a sliding door, a rail provided on the sliding door, a movable support portion secured to an outer frame of the sliding door and configured to move along the rail in accordance with opening and closing motions of the sliding door, a fitting portion having a width smaller than the breadth of the movable support portion and provided on at least a part of the rail, a rebound preventing unit having a breadth smaller than that of the fitting portion and provided on the outer frame of the sliding door, and a pressing mechanism configured to press the rebound preventing unit against the rail or the fitting portion. The fitting portion is provided in a position on the rebound preventing unit on the rail with the sliding door at a closed end thereof and/or a position on the rebound preventing unit on the rail with the sliding door at an open end thereof.

A second aspect of the rebound suppression system for sliding door according to the present invention comprises a sliding door, a rail provided on an outer frame of the sliding door, a movable support portion secured to the sliding door and configured to move along the rail in accordance with opening and closing motions of the sliding door, a fitting portion having a width smaller than the breadth of the movable support portion and provided on at least a part of the rail, a rebound preventing unit having a breadth smaller than that of the fitting portion and provided on the sliding door, and a pressing mechanism configured to press the rebound preventing unit against the rail or the fitting portion. The fitting portion is provided in a position on the rebound preventing unit on the rail with the sliding door at a closed end thereof and/or a position on the rebound preventing unit on the rail with the sliding door at an open end thereof.

The fitting portion may be in a slope shape inclined toward an end portion of the rail or recess-shaped.

The pressing mechanism for the rebound preventing unit may have a structure combining an elastic body and a unidirectional damper.

The movable support portion may be a roller configured to rotate on the rail or a sliding member configured to slide on the rail.

The rebound preventing unit may be a roller or a ball roller.

According to the present invention, a rebound suppression system for sliding door can be constructed in a position where rollers and a rail of a sliding door are provided, so that interference with other components can easily be avoided, and moreover, the rebound suppression system can be implemented by only changing the shape of a part of the rail and adding a rebound preventing roller and a pressing mechanism attached to the sliding door, so that it can easily be incorporated in an existing machine.

BRIEF DESCRIPTION OF THE DRAWINGS

The above and other objects and features of the present invention will be obvious from the ensuing description of embodiments with reference to the accompanying drawings, in which:

FIGS. 6A and 6B are enlarged views showing the vicinity of the rebound preventing roller in the rebound suppression system for sliding door of FIG. 1 with a sliding door at its closed end, in which FIG. 6A is a perspective view, and FIG. 6B is a view taken in the direction indicated by F in FIG. 6A;

FIGS. 8A and 8B are side views illustrating a rebound suppression system for sliding door according to a second embodiment of the present invention, in which FIG. 8A is a side view of the rebound suppression system for sliding door taken in the movement direction of a sliding door similar to direction F in FIG. 6A, and FIG. 8B is a side view taken from the front-surface side of the sliding door;

FIGS. 9A and 9B are enlarged side views showing the vicinity of a rebound preventing roller of the rebound suppression system for sliding door of FIGS. 8A and 8B with the sliding door at its closed end, in which FIG. 9A is a side view of the rebound suppression system for sliding door taken in the movement direction of a sliding door similar to direction F in FIG. 6A, and FIG. 9B is a side view taken from the front-surface side of the sliding door;

FIGS. 10A and 10B are side views illustrating a rebound suppression system for sliding door according to a third embodiment of the present invention, in which FIG. 10A is a side view of the rebound suppression system for sliding door taken in the movement direction of a sliding door similar to direction F in FIG. 6A, and FIG. 10B is a side view taken from the front-surface side of the sliding door;

FIGS. 11A and 11B are enlarged side views showing the vicinity of a rebound preventing roller of the rebound suppression system for sliding door of FIGS. 10A and 10B with the sliding door moved to its open end, in which FIG. 11A is a side view of the rebound suppression system for sliding door taken in the movement direction of the sliding door similar to direction F in FIG. 6A, and FIG. 11B is a side view taken from the front-surface side of the sliding door;

FIGS. 12A and 12B are side views illustrating a rebound suppression system for sliding door according to a fourth embodiment of the present invention, in which FIG. 12A is a side view of the rebound suppression system for sliding door taken in the movement direction of a sliding door similar to direction F in FIG. 6A, and FIG. 12B is a side view taken from the front-surface side of the sliding door;

FIGS. 13A and 13B are enlarged side views showing the vicinity of a rebound preventing roller of the rebound suppression system for sliding door of FIGS. 12A and 12B with the sliding door moved to its open end, in which FIG. 13A is a side view of the rebound suppression system for sliding door taken in the movement direction of the sliding door similar to direction F in FIG. 6A, and FIG. 13B is a side view taken from the front-surface side of the sliding door;

FIGS. 16A and 16B are side views illustrating an example of the rebound suppression system for sliding door according to the present invention using a ball roller, in which FIG. 16A is a side view of the rebound suppression system for sliding door taken in the movement direction of a sliding door similar to direction F in FIG. 6A, and FIG. 16B is a side view taken from the front-surface side of the sliding door;

FIGS. 17A and 17B are enlarged side views showing the vicinity of a rebound preventing roller of the rebound suppression system for sliding door of FIGS. 16A and 16B with the sliding door moved to its open end, in which FIG. 17A is a side view of the rebound suppression system for sliding door taken in the movement direction of a sliding door similar to direction F in FIG. 6A, and FIG. 17B is a side view taken from the front-surface side of the sliding door;

DETAILED DESCRIPTION OF THE PREFERRED EMBODIMENTS

A first embodiment of a rebound suppression system for sliding door according to the present invention will first be described with reference to FIGS. 1 to 7.

Figure 1:
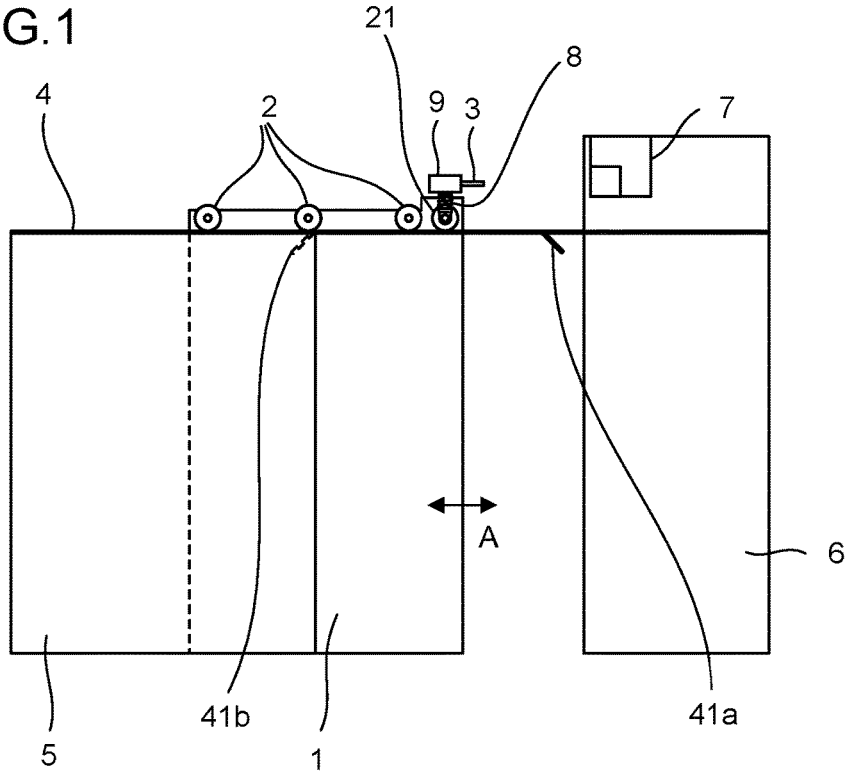
FIG. 1 is a diagram illustrating a rebound suppression system for sliding door according to a first embodiment of the present invention.

FIG. 1 is a configuration diagram showing one embodiment of the rebound suppression system for sliding door according to the present invention.

In the rebound suppression system for sliding door of the present embodiment, a rail 4 secured to an outer frame (not shown) of the sliding door is provided with slope portions (slope portions 41*a* and 41*b* in FIG. 1) on one or several parts thereof. A sliding door 1 is provided with rollers 2 and a rebound preventing roller 21. The rollers 2 roll on the rail 4, thereby supporting the sliding door 1 for movement in the direction indicated by A in FIG. 1. The rebound preventing roller 21 is always pressed against the rail 4 by a pressing mechanism 8.

Figure 2:
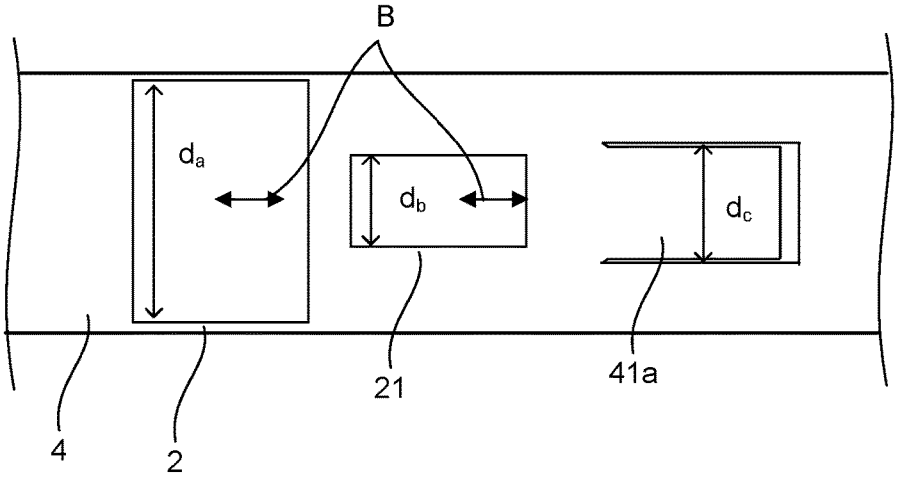
FIG. 2 is a diagram illustrating the width size of a slope portion of a rail constituting the rebound suppression system for sliding door of FIG. 1.

The slope portions 41*a* and 41*b* can be shaped so that their one ends are linearly diagonally cut down, by way of example. As shown in FIG. 2, moreover, the slope portion 41*a* is formed so that its width $d_c$ (dimension orthogonal to the movement directions of the rollers 2 and 21 indicated by B in FIG. 2) is smaller than a width $d_a$ of each roller 2 and slightly greater than the width of the rebound preventing roller 21. In this way, the rollers 2 can always be kept in contact with the rail 4 without regard to whether they are located ahead of, behind, or just above the slope portion 41*a*. Thus, the slope portion 41*a* (and the slope portion 41*b*) can be provided on any part of the rail 4.

Figure 3:
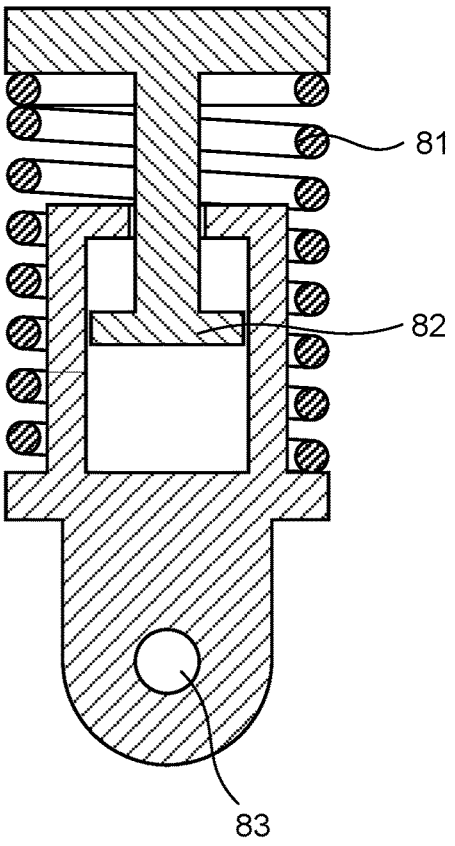
FIG. 3 is a cross-sectional view of a pressing mechanism 8 of FIG. 1 and configured to press a rebound preventing roller against the rail.

FIG. 3 is a view illustrating the pressing mechanism 8 that presses the rebound preventing roller 21 against the rail 4.

The pressing mechanism 8, as illustrated, comprises a unidirectional damper 82, which constitutes a flexible part, and a spring 81 configured always to apply a force in the direction to extend the flexible part. With this arrangement of the pressing mechanism 8, the rebound preventing roller 21 attached to a fixing hole 83 can be pressed against the rail 4 and vibration generated in the flexible part of the pressing mechanism 8 can be absorbed by the unidirectional damper 82.

Figure 4:
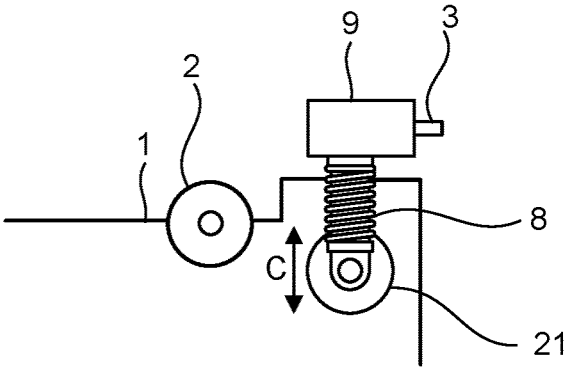
FIG. 4 is an enlarged diagram showing the vicinity of the rebound preventing roller and the pressing mechanism of the sliding door in the rebound suppression system for sliding door of FIG. 1.

FIG. 4 is an enlarged diagram showing the vicinity of the rebound preventing roller 21 and the pressing mechanism 8 of the sliding door 1 in the rebound suppression system for sliding door of FIG. 1.

As shown in FIG. 4, the pressing mechanism 8 is supported by a support portion 9 secured to the sliding door 1. The rebound preventing roller 21 attached to the fixing hole 83 of the pressing mechanism 8 is configured to move in the direction indicated by C in FIG. 4. Preferably, the movable range of the rebound preventing roller 21 should be set such that at least the lower end of the rebound preventing roller 21 can move upward to a position at the same height as the lower end of the rollers 2 attached to the sliding door 1 and move downward to a position at the same height as the lower end of the portions 41*a* and 41*b*.

Moreover, the rebound preventing roller 21 is always pressed against the rail 4 by the spring 81 of the pressing mechanism 8.

Figure 5:
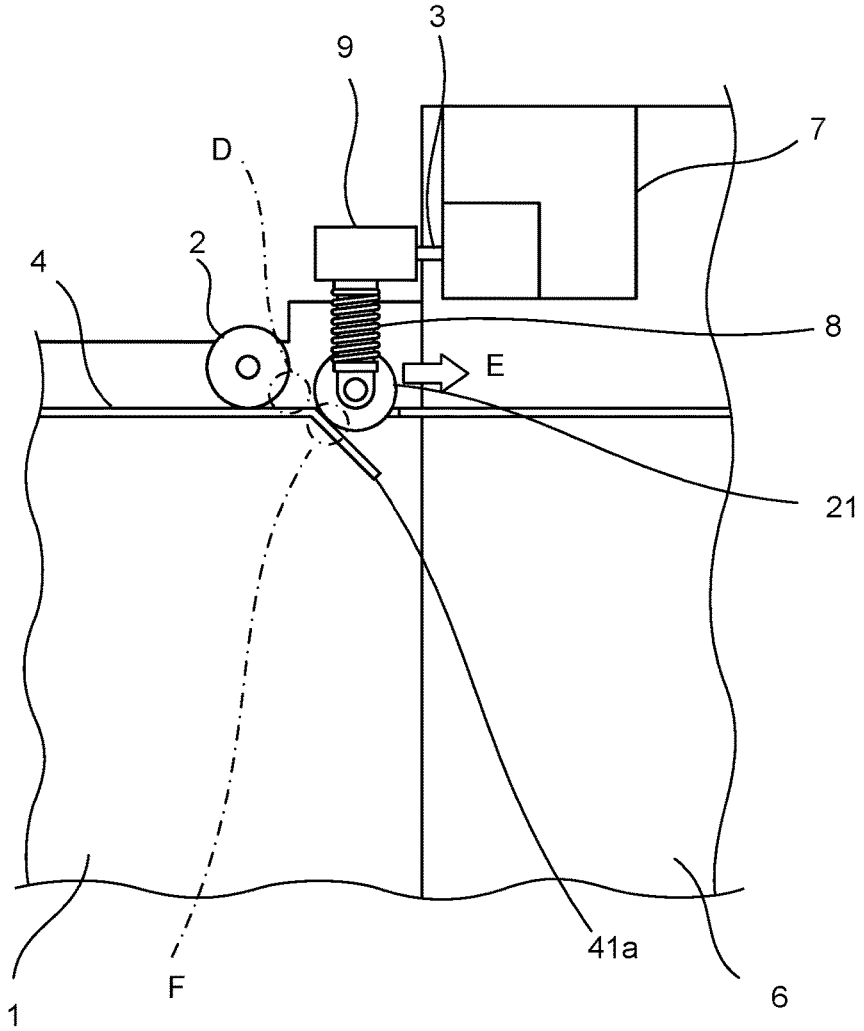
FIG. 5 is a diagram illustrating the function of the rebound preventing roller and the slope portion of the rail in the rebound suppression system for sliding door of FIG. 1.

According to the rebound suppression system for sliding door with the configuration described above, if an operator moves the sliding door 1 toward its closed end (i.e., in the direction to close the sliding door 1) by means of the rollers 2 rotating in contact with the rail 4, the sliding door 1 is moved without resistance along the rail 4 when the rebound preventing roller 21 is on the rail 4. When the sliding door 1 is moved to the vicinity of its closed end so that the rebound preventing roller 21 fits into the slope portion 41*a* of the rail 4, as shown in FIG. 5, the rebound preventing roller 21 is pressed against the slope portion 41*a* by the pressing mechanism 8. Consequently, a counter force against the rebound preventing roller 21 is generated by the slope portion 41*a*, and the generated counter force is transmitted to the support portion 9 so that the sliding door 1 is pressed toward a door frame 6 (in the direction indicated by E in FIG. 5). Thus, the sliding door 1 can be kept from rebounding when it collides swiftly with the door frame 6.

Figure 6A:
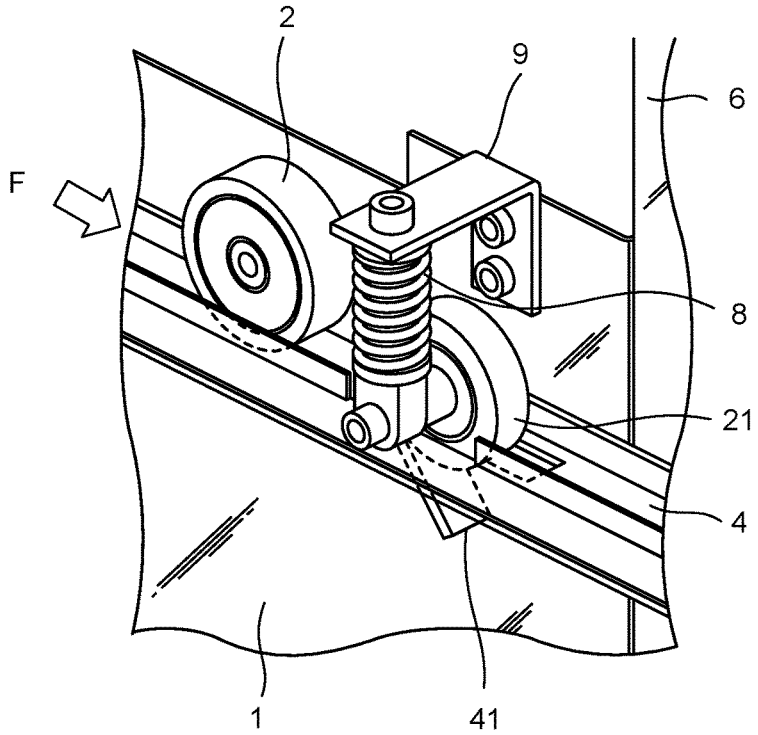
Figure 6B:
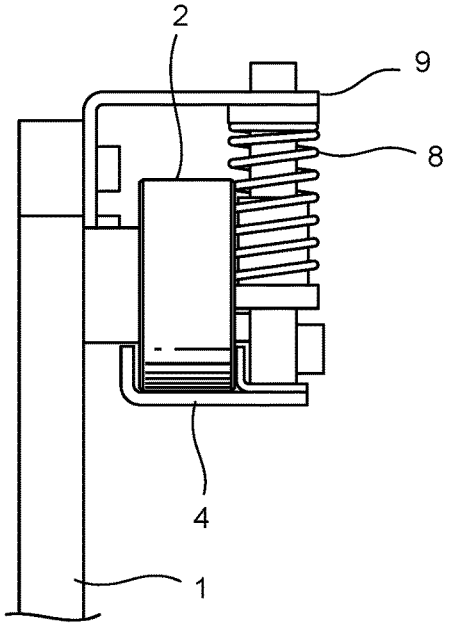

FIGS. 6A and 6B show the vicinity of the rebound preventing roller 21 and the slope portion 41*a* of the rail 4 in the rebound suppression system for sliding door with the sliding door 1 at its closed end (or in a closed state), in which FIG. 6A is a perspective view, and FIG. 6B is a view taken in the direction indicated by F in FIG. 6A.

As the rebound preventing roller 21 fits into the slope portion 41*a* of the rail 4, as shown in FIGS. 6A and 6B, the force to press the sliding door 1 against the door frame 6 is transmitted through the support portion 9, whereby the sliding door 1 is prevented from rebounding.

Figure 7:
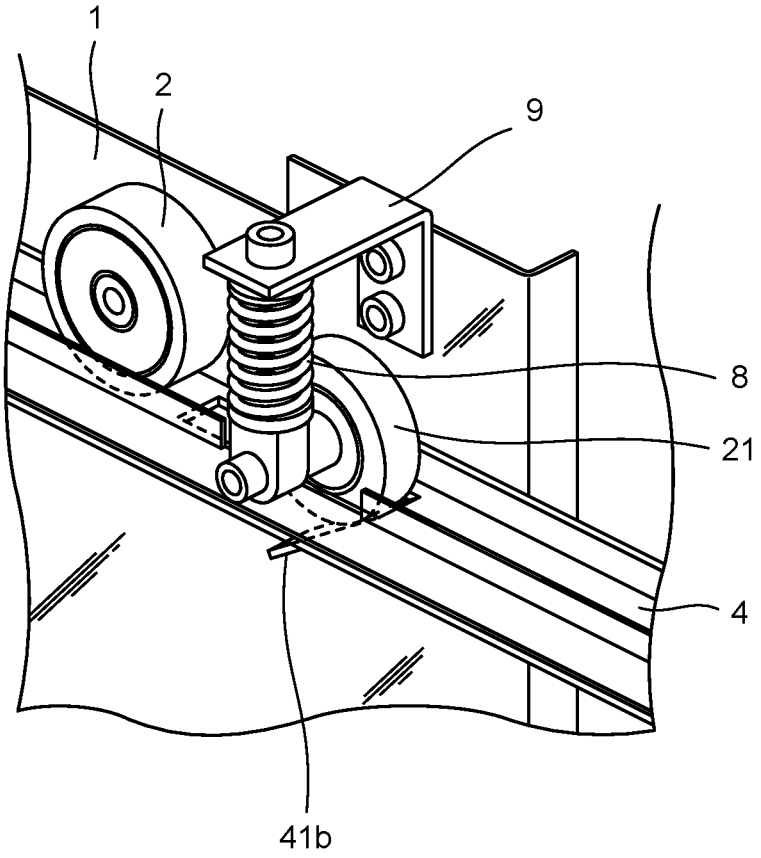
FIG. 7 is an enlarged view showing the vicinity of the rebound preventing roller in the rebound suppression system for sliding door of FIG. 1 with the sliding door at its open end.

FIG. 7 is a perspective view showing the vicinity of the rebound preventing roller 21 and the slope portion 41*a* of the rail 4 with the sliding door 1 at its open end (or in an open state).

If the sliding door 1 is translated toward its open end (in the direction to open the sliding door 1), the rebound preventing roller 21 fits into the slope portion 41*b* that is inclined opposite to the slope portion 41*a* in the vicinity of the open end of the sliding door 1, as shown in FIG. 7, so that the upper end of the sliding door 1 can be pressed against the innermost part of the sliding door to keep the sliding door 1 from rebounding in like manner.

If the operator applies a force to move the sliding door 1 at its closed or open end toward the open or closed end, moreover, the rebound preventing roller 21 pushes up the pressing mechanism 8 as it ascends along the slopes of the slope portions 41*a* and 41*b*. Thus, the sliding door 1 can be moved without requiring an excessive force.

In the rebound suppression system for sliding door of the present embodiment with the configuration described above, the sliding door 1 is pressed toward the door frame 6 when it is at its closed end and is pressed against the innermost part of a door pocket 5 when it is at its open end, by the counter force acting between the rebound preventing roller 21 and the slope portions 41*a* and 41*b*. Therefore, the sliding door 1 can be kept from rebounding if it is swiftly opened or closed. When the sliding door is at its open or closed end, moreover, a force always acts to fully open or close the sliding door. Accordingly, the occurrence of so-called "rattling of a sliding door" can be suppressed without any special adjustment of the positional relationship between the rebound preventing roller 21 and the rail 4. Thus, no gap is created between the sliding door 1 and the door frame 6 at the closed end, in particular, so that mist and chips can be prevented from leaking out of a protective cover.

In the present embodiment, the rebound preventing roller 21 is always kept in contact with the rail and the slope portions by the pressing force of the spring 81 of the pressing mechanism 8. By appropriately selecting the spring 81, the sliding door 1 can be prevented from rebounding and production of a heavy load can be prevented when the sliding door 1 is opened. Moreover, if the selected unidirectional damper 82 has a performance capable of suppressing the occurrence of a rebound of the sliding door 1, the sliding door 1 can be kept from rebounding when it collides swiftly with the innermost parts of the door frame 6 and the door pocket 5. When the operator opens the sliding door 1 at normal speed, moreover, the counter force from the unidirectional damper 82 is so small that the sliding door 1 can be moved without requiring any excessive force, as described above.

The rebound suppression system for sliding door of the present embodiment can be installed within a range in which the rollers 2 and the rail 4 as constituent elements of the sliding door 1 move. Since no other components are provided on that part of the sliding door 1 where the rollers 2 and the rail 4 are installed, in order to avoid interference with the movable sliding door, the rebound suppression system for sliding door never interferes with the other components. Moreover, the rebound suppression system for sliding door can easily be incorporated in an existing machine, since it can be implemented by only changing the shape of a part of the rail 4 and adding the pressing mechanism 8 and the rebound preventing roller 21 attached to the sliding door 1.

Moreover, that part of the sliding door 1 where the rollers 2 and the rail 4 are in contact with one another are normally isolated from mist and chips, so that the failure rate of the rebound suppression system for sliding door can be reduced.

Furthermore, the two slope portions 41*a* and 41*b* that are inclined in opposite directions to each other are individually provided on the rail 4, so that the sliding door 1 can be prevented from rebounding by using the single rebound preventing roller 21 in case where the sliding door 1 is closed and also in case where the sliding door 1 is opened.

A second embodiment of the rebound suppression system for sliding door according to the present invention will now be described with reference to FIGS. 8A to 9B.

In the first embodiment described above, the rollers 2 are provided on the sliding door 1, and the rail 4 is secured to the outer frame of the sliding door. In the second embodiment, rollers 2 are provided on an outer frame of a sliding door 1, and a rail 4 is secured to the sliding door.

Figure 8A:
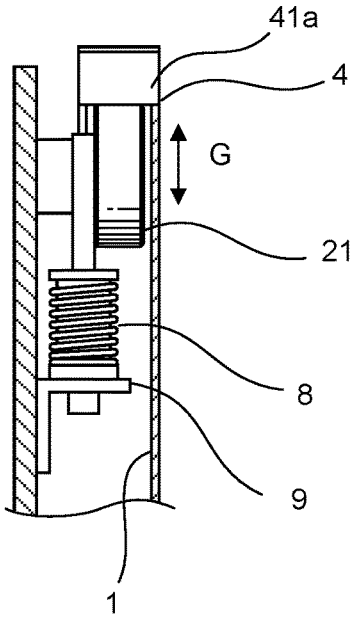
Figure 8B:
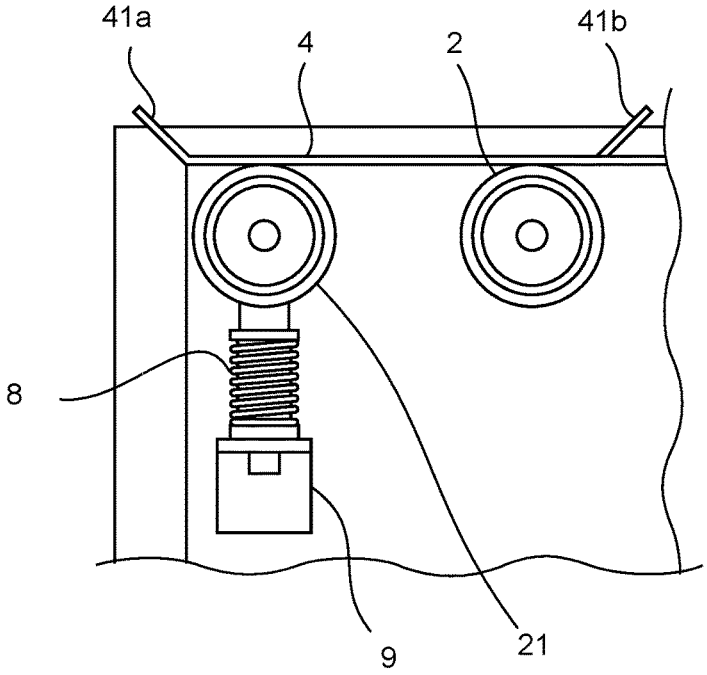

FIGS. 8A and 8B are views illustrating the rebound suppression system for sliding door, in which FIG. 8A is a view of the rebound suppression system taken in the movement direction of the sliding door, and FIG. 8B is a view taken from the front-surface side of the sliding door. In FIG. 8B, however, the illustration of the sliding door is omitted so that the inner structure is seeable.

In the rebound suppression system for sliding door of the present embodiment, as shown in FIGS. 8A and 8B, the rail 4 is provided on the sliding door 1, and the rollers 2 are secured to the outer frame of the sliding door. Moreover, a pressing mechanism 8 is supported by a support portion 9 secured to the sliding door 1. A rebound preventing roller 21 attached to a fixing hole 83 (see FIG. 3) of the pressing mechanism 8 is configured to move in the direction indicated by G in FIG. 8A. Furthermore, the rail 4 is provided with two slope portions 41*a* and 41*b* that are inclined in opposite directions to each other, as shown in FIG. 8B.

Figure 9A:
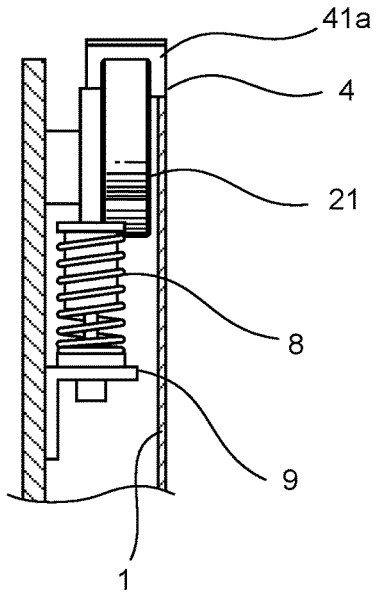
Figure 9B:
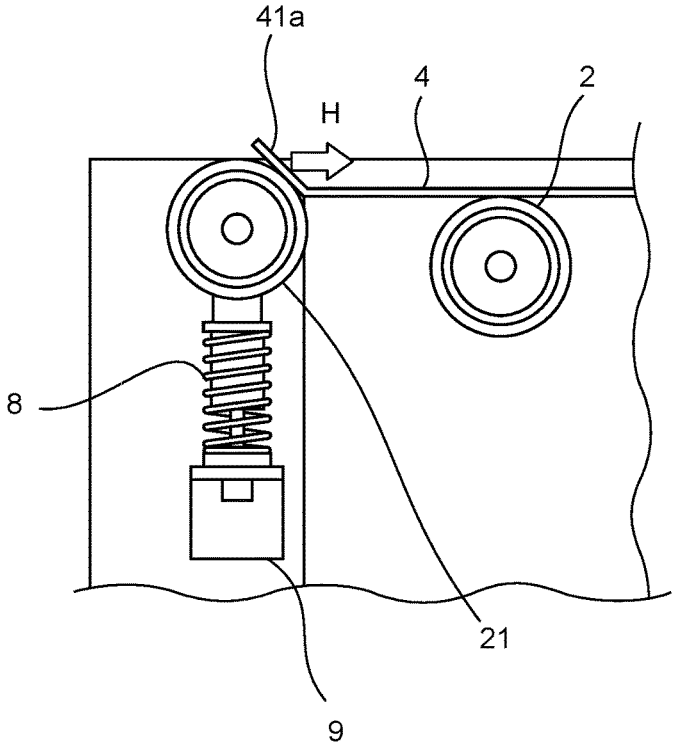

FIGS. 9A and 9B are enlarged views illustrating the vicinity of the rebound preventing roller of the rebound suppression system for sliding door with the sliding door 1 at its closed end (or in a closed state). FIG. 9A is a view of the rebound suppression system for sliding door taken in the movement direction of the sliding door, and FIG. 9B is a view taken from the front-surface side of the sliding door. In FIG. 9B, the illustration of the sliding door is omitted so that the inner structure is seeable.

When the sliding door 1 is at its closed end, as shown in FIG. 9A, the rebound preventing roller 21 is pushed up by the pressing mechanism 8 so that it rolls up the slope portion 41*a*, whereupon the rebound preventing roller 21 is pressed against the slope portion 41*a*. As the slope portion 41*a* of the rail 4 is then pushed by the rebound preventing roller 21, as shown in FIG. 9B, the sliding door 1 is pressed toward a door frame 6 (in the direction indicated by H in FIG. 9B), whereby the sliding door 1 can be kept from rebounding.

When the sliding door 1 is at its open end (not shown), the rebound preventing roller 21 is pushed up by the pressing mechanism 8 so that it rolls up the slope portion 41*b* (see FIG. 8B), whereupon the rebound preventing roller 21 is pressed against the slope portion 41*b*. As the slope portion 41*b* of the rail 4 is then pushed by the rebound preventing roller 21, the upper end of the sliding door 1 is pressed against the innermost part of a door pocket, whereby the sliding door 1 can be kept from rebounding.

Figure 10A:
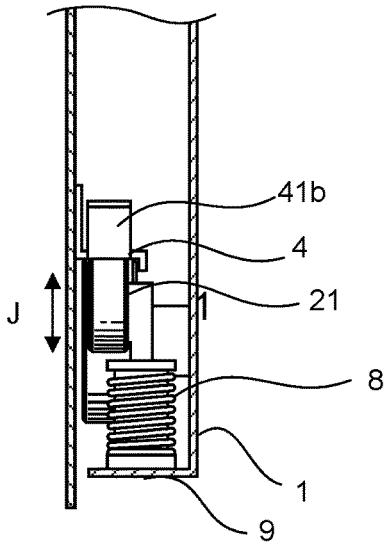
Figure 10B:
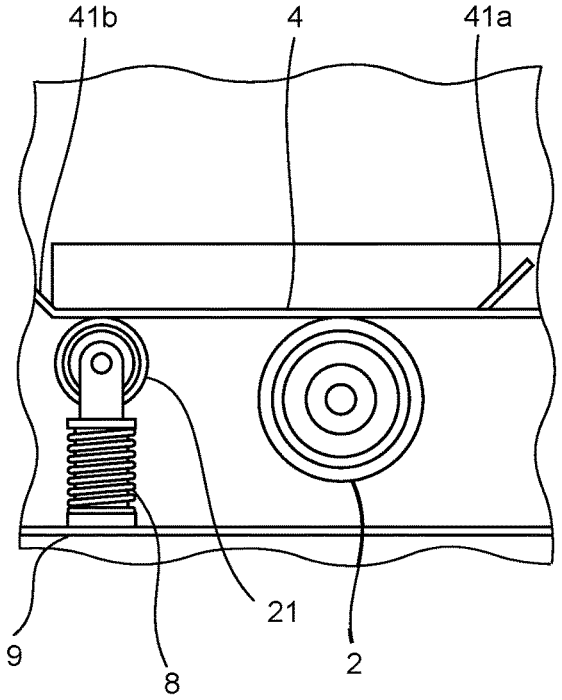

A third embodiment of the rebound suppression system for sliding door according to the present invention will now be described with reference to FIGS. 10A to 11B. FIG. 10A is a view of the rebound suppression system for sliding door taken in the movement direction of a sliding door, and FIG. 10B is a view taken from the front-surface side of the sliding door. In FIG. 10B, the illustration of the sliding door is omitted so that the inner structure is seeable.

In the rebound suppression system for sliding door of the present embodiment, as in the first embodiment, rollers 2 are provided on a sliding door 1, and a rail 4 is secured to an outer frame of the sliding door, as shown in FIGS. 10A and 10B. Moreover, a pressing mechanism 8 is supported upwardly relative to a support portion 9, which is secured to the sliding door 1, by the support portion 9. A rebound preventing roller 21 attached to a fixing hole 83 (see FIG. 3) of the pressing mechanism 8 is configured to move in the direction indicated by J in FIG. 10A. Furthermore, the rail 4 is provided with two slope portions 41*a* and 41*b* that are inclined in opposite directions to each other, as shown in FIG. 10B.

Figure 11A:
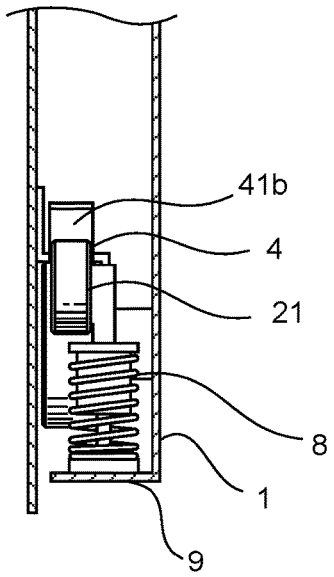
Figure 11B:
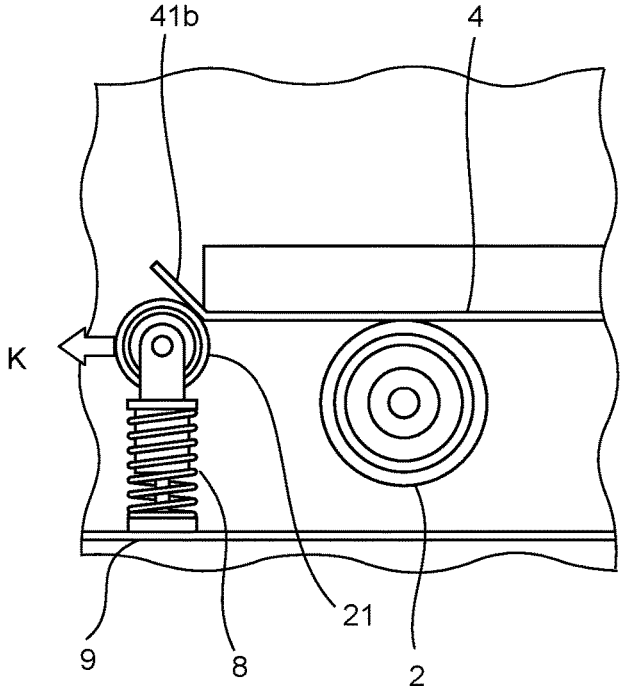

FIGS. 11A and 11B are enlarged views illustrating the vicinity of the rebound preventing roller of the rebound suppression system for sliding door shown in FIGS. 10A and 10B with the sliding door 1 moved to its open end. FIG. 11A is a view of the rebound suppression system for sliding door taken in the movement direction of the sliding door 1, and FIG. 11B is a view taken from the front-surface side of the sliding door. In FIG. 11B, the illustration of the sliding door 1 is omitted so that the inner structure is seeable.

When the sliding door 1 is at its open end, as shown in FIG. 11B, the rebound preventing roller 21 is pushed up by the pressing mechanism 8 so that it rolls up the slope portion 41*b*, whereupon the rebound preventing roller 21 is pressed against the slope portion 41*b*. As the rebound preventing roller 21 is pushed by a counter force from the slope portion 41*b*, the sliding door 1 is pressed toward the innermost part of a door pocket (in the direction indicated by K in FIG. 11B), whereby the sliding door 1 can be kept from rebounding.

When the sliding door 1 is at its closed end (not shown), the rebound preventing roller 21 is pushed up by the pressing mechanism 8 so that it rolls up the slope portion 41*a* (see FIG. 10B), whereupon the rebound preventing roller 21 is pressed against the slope portion 41*a*. As the rebound preventing roller 21 is pushed by a counter force from the slope portion 41*a*, the sliding door 1 is pressed toward a fiddle, whereby the sliding door 1 can be kept from rebounding.

A fourth embodiment of the rebound suppression system for sliding door according to the present invention will now be described with reference to FIGS. 12A to 13B.

Each of the first to third embodiments described above is provided with the system configured to suppress the sliding door 1 from rebounding by pressing the rebound preventing roller 21 against the slope portions 41*a* and 41*b* on the rail 4. In contrast, the present embodiment is provided with a system configured to suppress a sliding door from rebounding by pressing a rebound preventing roller 21 against a recess 42 in a rail 4.

Figure 12A:
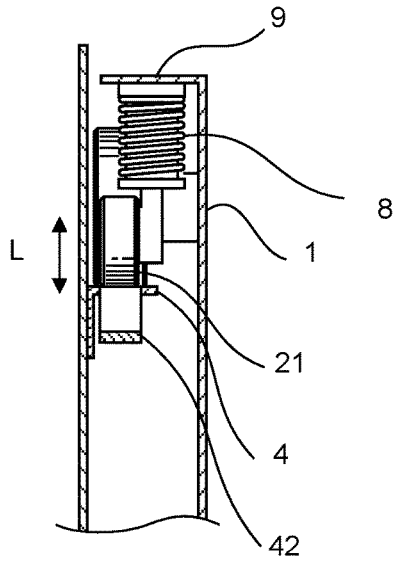
Figure 12B:
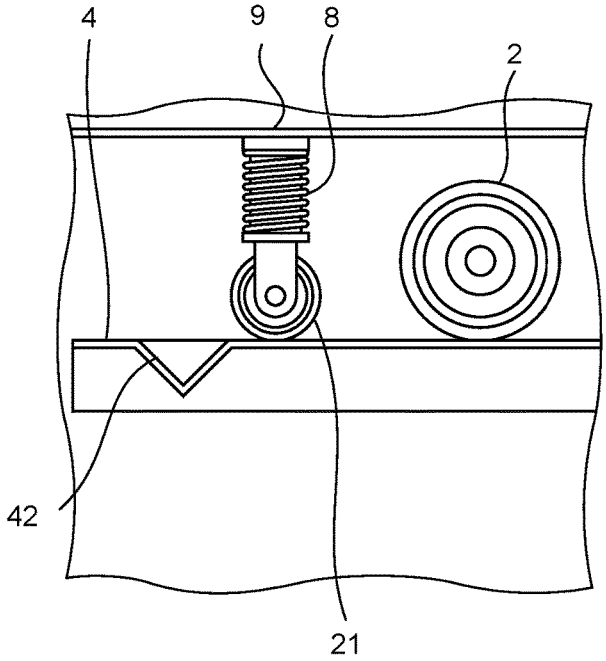

FIGS. 12A and 12B are views illustrating the rebound suppression system for sliding door according to the present embodiment. FIG. 12A is a view of the rebound suppression system for sliding door taken in the movement direction of the sliding door, and FIG. 12B is a view taken from the front-surface side of the sliding door. In FIG. 12B, the illustration of the sliding door is omitted so that the inner structure is seeable.

In the rebound suppression system for sliding door of the present embodiment, as shown in FIGS. 12A and 12B, rollers 2 are provided on a sliding door 1, and the rail 4 is secured to an outer frame of the sliding door. Moreover, a pressing mechanism 8 is supported by a support portion 9 secured to the sliding door 1. A rebound preventing roller 21 attached to a fixing hole 83 (see FIG. 3) of the pressing mechanism 8 is configured to move in the direction indicated by L in FIG. 12A. Furthermore, the rail 4 is provided with the recess 42, as shown in FIG. 12B.

Figure 13A:
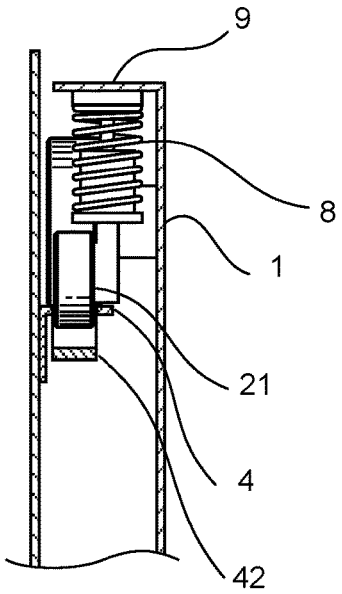
Figure 13B:
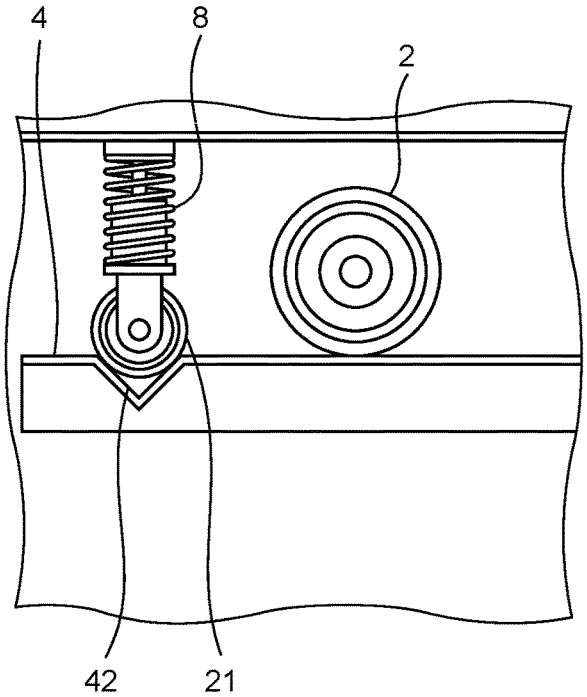

FIGS. 13A and 13B are enlarged views illustrating the vicinity of the rebound preventing roller of the rebound suppression system for sliding door shown in FIGS. 12A and 12B with the sliding door 1 moved to its open end. FIG. 13A is a view of the rebound suppression system for sliding door taken in the movement direction of the sliding door 1, and FIG. 13B is a view taken from the front-surface side of the sliding door. In FIG. 13B, the illustration of the sliding door is omitted so that the inner structure is seeable.

If the sliding door 1 is moved to the vicinity of its open end so that the rebound preventing roller 21 fits into the recess 42 of the rail 4, as shown in FIG. 13A, the rebound preventing roller 21 is pressed against the recess 42 by the pressing mechanism 8. Thereupon, a force is generated to keep the rebound preventing roller 21 in the lowest position of the recess 42. Thus, a function can also be used to prevent the sliding door 1 from colliding swiftly with the innermost part of the door pocket 5 and rebounding by adjusting the positional relationship between the recess 42 of the rail 4 and the innermost part of the door pocket 5. In this way, wear due to collision between the side of the sliding door 1 and the side of the door frame 6 can be prevented.

In case where another recess (separate from the recess 42 shown in FIG. 13B) is provided in a position on the rail 4 corresponding to the position of the rebound preventing roller 21 when the sliding door 1 is in the vicinity of its closed end, it is possible to prevent the sliding door 1 from colliding swiftly with the door frame 6 and rebounding at the closed end of the sliding door 1.

In the first to fourth embodiments described above, the present invention is applied to the configuration example of the sliding door 1 that mainly performs linear motion along the straight rail 4. However, the present invention is also applicable to a sliding door that moves along an arcuate rail, not straight, or a sliding door that has a rail at its outer peripheral portion and is rotatable around a rotation axis.

Figure 14:
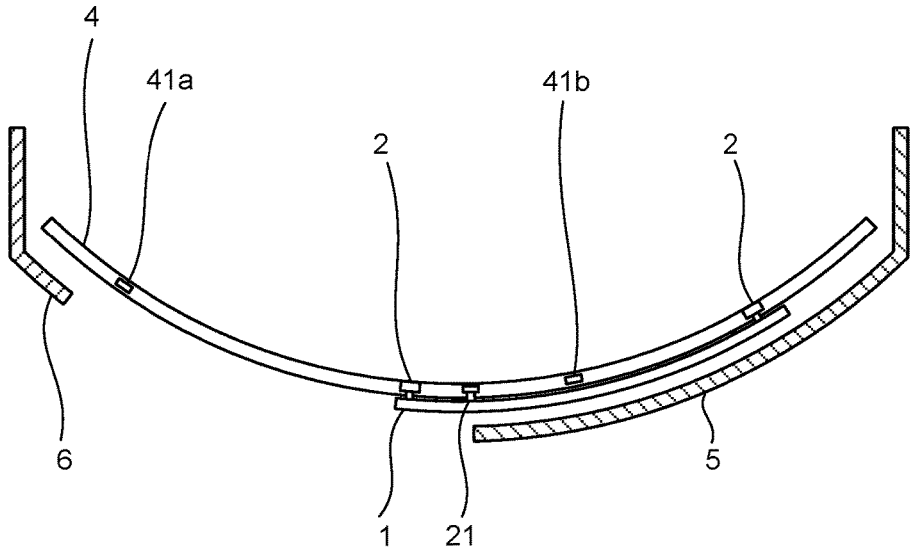
FIG. 14 is a top view illustrating a rebound suppression system for sliding door according to a fifth embodiment of the present invention.

Then, a fifth embodiment of the rebound suppression system for sliding door according to the present invention will be described with reference to FIG. 14. The present embodiment represents an example in which the present invention is applied to the sliding door that moves along the arcuate rail.

In the rebound suppression system for sliding door of the present embodiment, rollers 2 are provided on an arcuate sliding door 1, and an arcuate rail 4 is secured to an outer frame of the sliding door. Moreover, a rebound preventing roller 21 is supported by a support portion (not shown) secured to the sliding door 1, as in the other embodiments, and is constructed as a movable roller pressed against the rail 4 by a pressing portion, as in the other embodiments. Furthermore, the arcuate rail 4 is provided with two slope portions 41*a* and 41*b* that are inclined in opposite directions to each other, as in the other embodiments. The same effect of the other embodiments can be obtained in such a manner that the rebound preventing roller 21 fits into either of the slope portions 41*a* and 41*b*, thereby pressing the sliding door 1 toward the innermost part of a door frame 6 or a door pocket 5. As regards the construction of the arcuate sliding door 1, the rail 4 may be provided on the sliding door 1 with the rollers 2 secured to the outer frame of the sliding door, the rebound preventing roller 21 may be supported upwardly, a recess such as that shown in FIG. 12B may be provided in place of the slope portions 41*a* and 41*b* of the rail 4.

Figure 15:
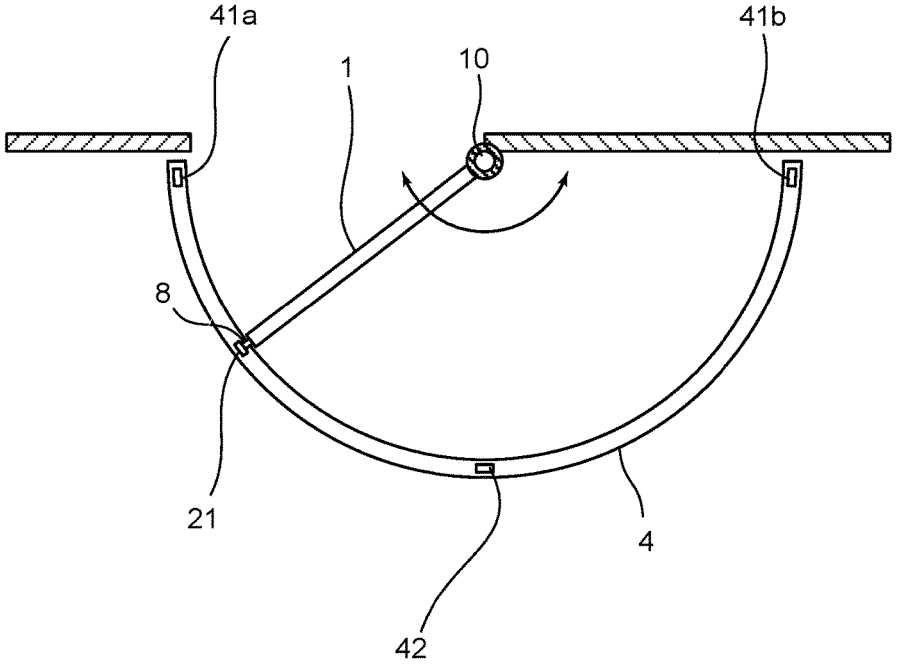
FIG. 15 is a top view illustrating a rebound suppression system for sliding door according to a sixth embodiment of the present invention.

Moreover, a sixth embodiment of the rebound suppression system for sliding door according to the present invention will be described with reference to FIG. 15. The present embodiment represents an example in which the present invention is applied to a sliding door that is rotatable around a rotation axis.

In the rebound suppression system for sliding door of the present embodiment, a rebound preventing roller 21 that moves along a semicircular rail 4 is provided on the distal end portion of a sliding door 1 rotatable around a rotation axis. As in the other embodiments, the rebound preventing roller 21 is constructed as a movable roller pressed against the rail 4 by a pressing mechanism 8 supported by a support portion (not shown) that is secured to the sliding door 1. Moreover, the semicircular rail 4 is provided with two slope portions 41*a* and 41*b* that are inclined in opposite directions to each other, as in the other embodiments. As the rebound preventing roller 21 fits into either of the slope portions 41*a* and 41*b*, the sliding door 1 can be prevented from colliding swiftly with a protective cover and rebounding. Furthermore, the sliding door 1 can be kept in a predetermined position by providing a recess 42, in place of the slope portions 41*a* and 41*b*, in a predetermined position on the rail 4, as shown in FIG. 13B.

While embodiments of the present invention have been described herein, the invention is not limited to the above-described embodiments and may be suitably modified and embodied in various forms.

Figure 16A:
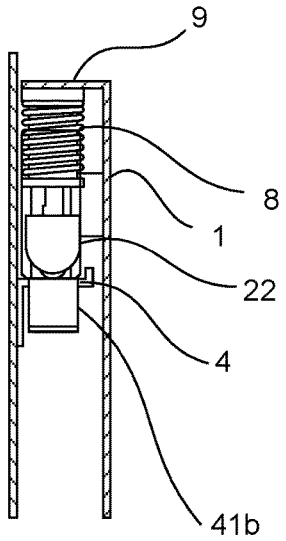
Figure 16B:
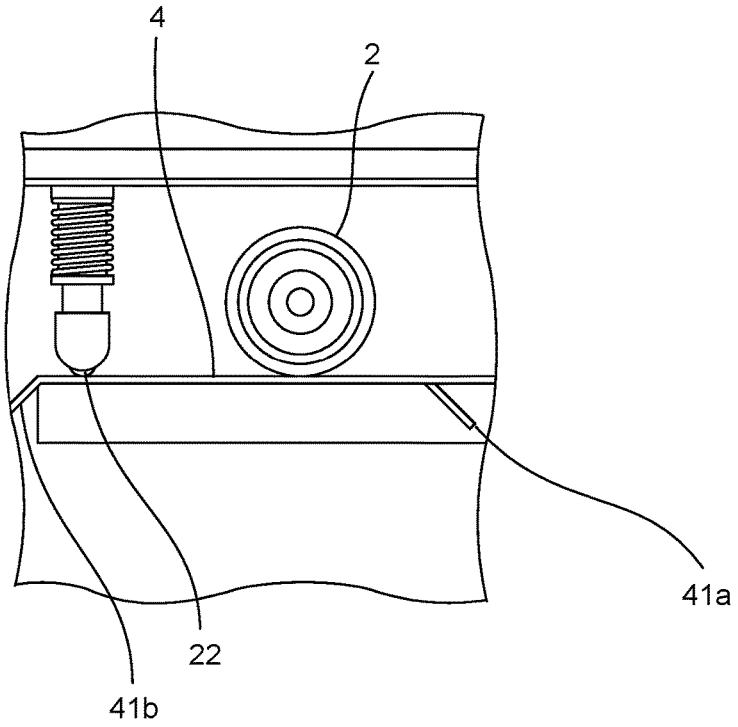

Although the rebound preventing roller 21 is used as a mechanism for preventing rebound in each of the embodiments described above, for example, a ball roller may alternatively be used as the rebound suppression system. FIGS. 16A and 16B are views illustrating an example of the rebound suppression system for sliding door using the ball roller. FIG. 16A is a view of the rebound suppression system for sliding door taken in the movement direction of the sliding door, and FIG. 16B is a view taken from the front-surface side of the sliding door. In FIG. 16B, the illustration of the sliding door is omitted so that the inner structure is seeable.

In the example of FIGS. 16A and 16B, the rollers 2 are provided on the sliding door 1, and the rail 4 is secured to the outer frame of the sliding door. Moreover, the pressing mechanism 8 is supported by the support portion 9 secured to the sliding door 1, and a ball roller 22 for rebound prevention is attached to the distal end of the pressing mechanism 8. Furthermore, the rail 4 is provided with the two slope portions 41*a* and 41*b* that are inclined in opposite directions to each other, as shown in FIG. 16B.

Figure 17A:
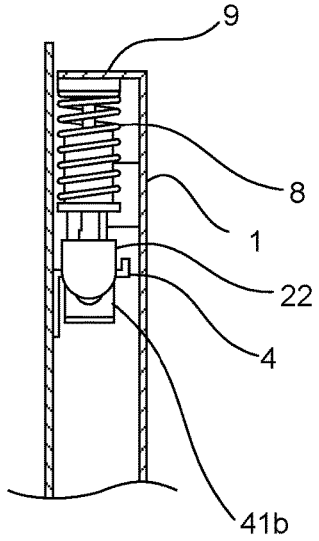
Figure 17B:
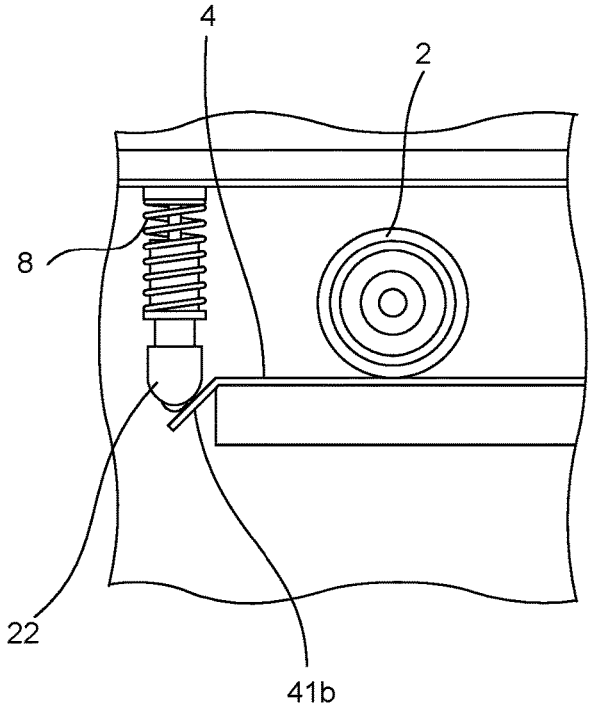
Figure 18:
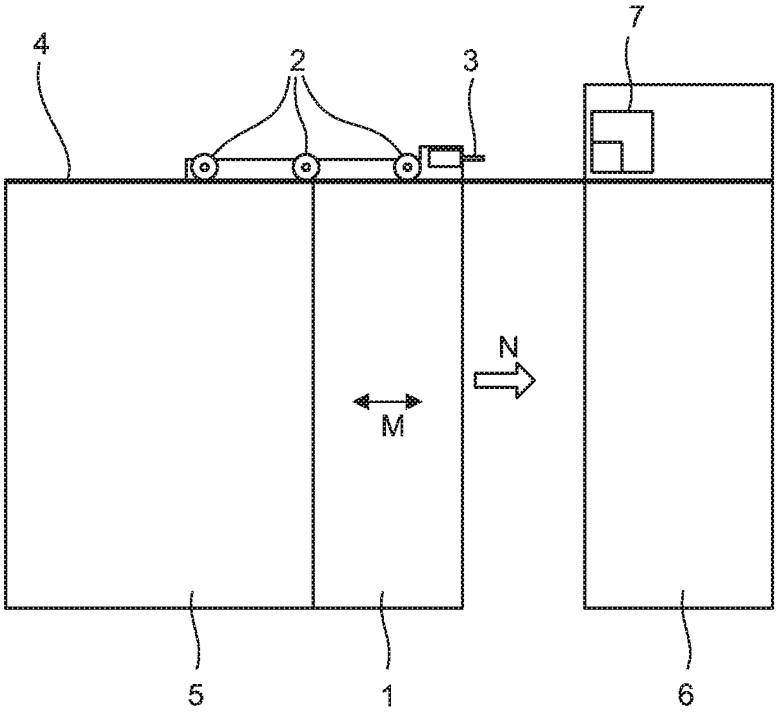
FIG.18 (Prior Art)
FIG. 18 is a diagram showing the structure of a conventional sliding door.
Figure 19:
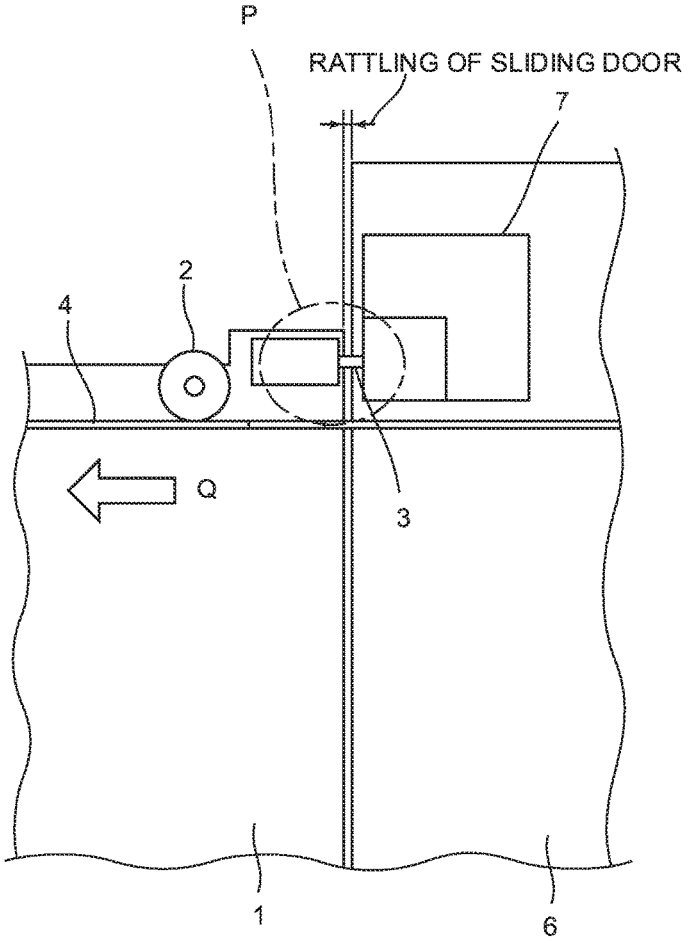
FIG.19 (Prior Art)
FIG. 19 is a diagram illustrating a problem of the structure of the conventional sliding door.

FIGS. 17A and 17B are views illustrating the rebound suppression system for sliding door shown in FIGS. 16A and 16B with the sliding door 1 moved to its open end. FIG. 17A is a view of the rebound suppression system for sliding door taken in the movement direction of the sliding door, and FIG. 17B is a view taken from the front-surface side of the sliding door. In FIG. 17B, the illustration of the sliding door is omitted so that the inner structure is seeable.

When the sliding door 1 is at its open end, as shown in FIG. 17A, the ball roller 22 for rebound prevention fits into the slope portion 41*b* of the rail 4. Then, as in the first embodiment, the sliding door 1 is pressed toward the innermost part of the door pocket by a counter force from the slope portion 41*b*, whereby the sliding door 1 can be kept from rebounding. This also applies to the case where the sliding door 1 is at its open end.

Moreover, according to the embodiments described above, the rebound preventing roller 21 is configured to fit into the slope portion 41*a* or 41*b* or the recess 42 on the rail 4, thereby preventing the sliding door 1 from rebounding. However, the effect of the present invention can be obtained by providing a suitable configuration on the rail 4 in which the rebound preventing roller 21 is fitted, such as a hole portion or a pair of projections of an appropriate size, in place of the slope portion 41*a* or 41*b* or the recess 42.

Furthermore, the pressing mechanism 8 for the rebound preventing roller 21 used in the present invention may be formed of a structure such that the unidirectional damper 82 (FIG. 3) is used to enhance the pressing force against the rail 4 in accordance with the operation for closing or opening the sliding door 1. In this case, the rebound preventing roller 21 is pressed swiftly against the slope portion 41*a* or 41*b* only when the sliding door 1 is swiftly closed or opened, so that the sliding door 1 can be operated without any heavy load when the sliding door 1 is closed or opened at normal speed.

In a conventional sliding door structure, rails for a sliding door are provided above and below the sliding door, individually. However, the rebound suppression system for sliding door of the present invention can be provided on either or each of upper and lower rails, and moreover, the rebound suppression system for sliding door can be applied to another rail that is provided separately from the original sliding door rail.

Furthermore, the slope portions and the recess according to the above-described embodiments may be formed by pressing on the rail so that the surface of the rail in contact with the rollers is isolated from the outside and spatially separated from the reverse surface. If this is done, the rebound suppression system for sliding door can be protected even in such an environment that chips and mist adhere to the reverse surface of the rail.

Moreover, in the embodiments described above, the sliding door is translated along the rail by using the rollers as support members for supporting the movement of the sliding door. Alternatively, however, the members for supporting the movement of the sliding door may be sliding members that slide between the sliding door and the rail. In this way, a component comprising a transfer mechanism for moving the sliding door may be used as required.

Furthermore, the rollers and the ball roller as components of the rebound preventing mechanism may be replaced with a component comprising a similar transfer mechanism, a low-friction, wear-resistant metal or resin, and the like.

The invention claimed is:

1. A sliding door rebound suppression system, comprising:

an outer frame;

a sliding door movable relative to the outer frame, in opening and closing motions between a closed position and an open position;

a rail provided on a first one of the sliding door and the outer frame;

a movable support portion secured to a second one of the sliding door and the outer frame and configured to move relative to and along the rail in accordance with the opening and closing motions of the sliding door;

a fitting portion on the rail, wherein, in a width direction transverse to a movement direction of the sliding door in the opening and closing motions, the fitting portion has a width smaller than a width of the movable support portion;

a rebound preventing unit on the second one of the sliding door and the outer frame, wherein, in the width direction, the rebound preventing unit has a width smaller than the width of the fitting portion; and a pressing mechanism configured to press the rebound preventing unit against the rail or the fitting portion, wherein the rebound preventing unit is fit in the fitting portion when the sliding door is at one of the closed position and the open position.

2. The sliding door rebound suppression system according to claim 1, wherein the fitting portion is a slope inclined toward an end portion of the rail.

3. The sliding door rebound suppression system according to claim 1, wherein the fitting portion is a recess.

4. The sliding door rebound suppression system according to claim 1, wherein the pressing mechanism for the rebound preventing unit has a structure combining an elastic body and a unidirectional damper.

5. The sliding door rebound suppression system according to claim 1, wherein the movable support portion is a roller configured to rotate on the rail.

6. The sliding door rebound suppression system according to claim 1, wherein the movable support portion is a sliding member configured to slide on the rail.

7. The sliding door rebound suppression system according to claim 1, wherein the rebound preventing unit is a roller.

8. The sliding door rebound suppression system according to claim 1, wherein the rebound preventing unit is a ball roller.

9. The sliding door rebound suppression system according to claim 1, wherein the pressing mechanism is configured to always press the rebound preventing unit against the rail or the fitting portion.

10. The sliding door rebound suppression system according to claim 1, wherein the pressing mechanism is configured to always press the rebound preventing unit against the rail when the rebound preventing unit is not fit in the fitting portion, and the pressing mechanism is configured to always press the rebound preventing unit against the fitting portion when the rebound preventing unit is fit in the fitting portion.

11. The sliding door rebound suppression system according to claim 1, further comprising:

a further fitting portion on the rail, wherein in the width direction, the further fitting portion has a width smaller than the width of the movable support portion and greater than the width of the rebound preventing unit, the rebound preventing unit is fit in the fitting portion when the sliding door is at the closed position, and the rebound preventing unit is fit in the further fitting portion when the sliding door is at the open position.

12. The sliding door rebound suppression system according to claim 11, wherein the fitting portion and the further fitting portions are slopes inclined in opposite directions.

13. The sliding door rebound suppression system according to claim 1, wherein the movable support portion is movable on an upper surface of the rail, the fitting portion has an inclined surface extending obliquely downward from the upper surface of the rail, and the pressing mechanism is configured to always press the rebound preventing unit downward.

14. The sliding door rebound suppression system according to claim 1, wherein the movable support portion is movable on a lower surface of the rail, and the fitting portion has an inclined surface extending obliquely upward from the lower surface of the rail, and the pressing mechanism is configured to always press the rebound preventing unit upward.

15. The sliding door rebound suppression system according to claim 1, wherein the rail is an arcuate rail.

16. The sliding door rebound suppression system according to claim 15, wherein the sliding door has an arcuate shape corresponding to an arcuate shape of the arcuate rail.

17. The sliding door rebound suppression system according to claim 15, wherein the sliding door is rotatable about a rotational axis at an end of the sliding door, and has the movable support portion at an opposite end of the sliding door.

* * * * *